US010371371B2

(12) United States Patent
Fang et al.

(10) Patent No.: US 10,371,371 B2
(45) Date of Patent: Aug. 6, 2019

(54) VENTILATION KIT AND RECESSED LIGHT FIXTURE ASSEMBLY WITH VENTILATION

(71) Applicant: GE Lighting Solutions, LLC, East Cleveland, OH (US)

(72) Inventors: Min Fang, ShangHai (CN); Shuyi Qin, ShangHai (CN); Honglei Gao, ShangHai (CN); Tingting Wang, ShangHai (CN); Qi Long, ShangHai (CN)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/751,171

(22) PCT Filed: Aug. 10, 2016

(86) PCT No.: PCT/CN2016/094326

§ 371 (c)(1),
(2) Date: Feb. 8, 2018

(87) PCT Pub. No.: WO2017/025028

PCT Pub. Date: Feb. 16, 2017

(65) Prior Publication Data

US 2018/0231239 A1 Aug. 16, 2018

(30) Foreign Application Priority Data

Aug. 10, 2015 (CN) ..... 2015 1 0486662

(51) Int. Cl.
*F21V 21/00* (2006.01)
*F21V 33/00* (2006.01)
(Continued)

(52) U.S. Cl.
CPC ..... *F21V 33/0092* (2013.01); *F21S 8/026* (2013.01); *F21S 8/04* (2013.01); *F21V 21/041* (2013.01);
(Continued)

(58) Field of Classification Search
CPC ..... F21S 8/04; F21S 8/026; F21V 21/041; F21V 21/048; F21V 33/0088; F21V 33/0092
See application file for complete search history.

(56) References Cited

U.S. PATENT DOCUMENTS 3,353,472 A 11/1967 Lee et al.
3,506,822 A 4/1970 Mulvey et al.
(Continued)

FOREIGN PATENT DOCUMENTS

CN 2763384 Y 3/2006
CN 203940313 U 11/2014
(Continued)

OTHER PUBLICATIONS

International Search Report and Written Opinion issued in connection with corresponding PCT Application No. PCT/CN2016/094326 dated Oct. 27, 2016.
(Continued)

*Primary Examiner* — Ali Alavi
(74) *Attorney, Agent, or Firm* — Buckley, Maschoff & Talwalkar LLC

(57) ABSTRACT

This invention provides a ventilation kit adapted to be coupled to a recessed light fixture, and comprises two supporting members. The first is adapted to be coupled with at least one edge of the recessed light fixture, while the second is adapted to be coupled with the grid system of the ceiling. There is also through-hole for air circulation. Mounting the ventilation kit onto an existing recessed light fixture enables the existing recessed light fixtures to have either an air supply or air return ventilation feature. This invention also discloses a recessed light fixture assembly with either an air supply or air return ventilation feature.

11 Claims, 8 Drawing Sheets

(51) Int. Cl.

| | |
|---|---|
| ***F21S 8/02*** | (2006.01) |
| ***F21S 8/04*** | (2006.01) |
| ***F21V 21/04*** | (2006.01) |
| ***F24F 13/078*** | (2006.01) |

(52) U.S. Cl.
CPC ..... *F21V 21/048* (2013.01); *F21V 33/0088* (2013.01); *F24F 13/078* (2013.01)

(56) References Cited

U.S. PATENT DOCUMENTS

| | | | | |
|---|---|---|---|---|
| 3,636,340 | A | 1/1972 | Mulvey | |
| 3,668,998 | A | 6/1972 | Johnson et al. | |
| 4,449,166 | A | 5/1984 | Sharp | |
| 8,303,132 | B2 | 11/2012 | Fabbri et al. | |
| 8,523,383 | B1 | 9/2013 | Grigore et al. | |
| 2015/0176833 | A1* | 6/2015 | Horng | F21V 15/01 362/362 |
| 2017/0175991 | A1 | 6/2017 | Wong et al. | |

FOREIGN PATENT DOCUMENTS

| | | | |
|---|---|---|---|
| CN | 104728817 | A | 6/2015 |
| CN | 105020630 | A | 11/2015 |
| CN | 205136067 | U | 4/2016 |
| JP | H02-242512 | A | 9/1990 |
| KR | 20110012078 | A | 2/2011 |

OTHER PUBLICATIONS

Notice on the Second Office Action, China National Intellectual Property Administration, Chinese Application No. 20150486662.9, Apr. 12, 2019, 8 pgs.

* cited by examiner

VENTILATION KIT AND RECESSED LIGHT FIXTURE ASSEMBLY WITH VENTILATION

FIELD OF INVENTION

This invention relates to a ventilation kit adapted to be coupled to a recessed light fixture, as well as a recessed light fixture assembly with ventilation.

BACKGROUND OF THE INVENTION

Recessed light fixtures refer to light fixtures where the body structure of the light fixture is recessed into the building or other objects after installation and is not visible, such as lighting installed onto indoor ceilings. For existing recessed light fixtures, taking indoor lighting as example, they generally include a housing that is recessed into the ceiling, with a light source and a driving device arranged within the housing. Also included is a light diffusion plate arranged below the housing, and outward extended horizontal edge at the lower part of the periphery of the housing, with the edge for mounting the light fixture onto the grid system of the ceiling during installation.

For interior equipped with a HVAC system, ventilation openings are generally provided on the ceiling or walls near the ceiling, and usually include an air supply opening and an air return opening for sending conditioned air to the interior of the room. With part of the air entering the ceiling above through the return air vent, which mixes with the outdoor fresh air through the duct system, and is cooled and desiccated before re-entering the room.

In order to make the living room more aesthetically pleasing, the vents and recessed lighting fixtures on the ceiling or ceiling near the wall can be combined as a one. At present, the common recessed light fixtures with integrated ventilation have reduced the dimension of the light fixture housing and the light diffusion plate, utilizing the footprint that has been saved for the air vent. This method solves the problem that the light transmission area of the lamp is relatively small. The design of U.S. Pat. No. 8,303,132B2 places the vents on the lower side of the recessed light fixture. Although the light transmission area of the light fixture is not reduced, the problem exists that the structure is complicated and the issue of high cost where existing light fixtures need to be completely replaced.

SUMMARY OF THE INVENTION

The purpose of this invention is to provide a ventilation kit adapted to be coupled to a recessed light fixture without reducing the light transmission area of the recessed light fixture, which enables existing light fixtures to have ventilation features after installing the ventilation kit of the present invention.

A ventilation kit adapted to be coupled to a recessed light fixture, the recessed light fixture comprises of a housing and at least one edge extending from a lower portion of the housing, and includes two supporting members. The first is adapted to be coupled with at least one edge of the recessed light fixture, while the second is adapted to be coupled with the grid system of the ceiling. There is also through-hole for air circulation. When installing recessed light fixtures, the edge of the recessed light fixtures is usually mounted onto the ceiling grid, while this ventilation kit couples the recessed light fixture with the ceiling grid by means of a supporting member. The first supporting member is coupled with the edge of the recessed light fixture, while the second supporting member is used to rest on the grid system of the ceiling.

At least one through-hole in the supporting member is for fluid flow, and can be used for the flow of fluid between the space below the recessed light fixture and the space above the recessed light fixture. That is, the fluid flow of the air chambers or ducts of the interior and the HVAC system above the ceiling, including air supply and return air. In terms of usage, the through hole is used for air return from the space under the recessed light fixture to the space above the recessed light fixture.

The configuration of the supporting member, that is, the horizontal shape of the first and second portions of the supporting member, is generally the same as the edge configuration of the recessed light fixture. When the edge of the recessed light fixture comprises a straight edge, the corresponding supporting member is in the form of a straight rectangle. When the edge of the recessed light fixture comprises a curved edge, the corresponding supporting member should also have the same curvature. This facilitates the mounting of the supporting member onto the recessed light fixture, as well as facilitates the installation of the recessed light fixture with the venting kit installed onto the grid system of the ceiling, without changing the original light transmission area of the recessed light fixture. In terms of usage, a supporting member may be installed at one edge of the recessed light fixture. In this case, in an embodiment, the length of the supporting member is essentially the same as the length of one edge of the recessed light fixture. Also, one edge of the recessed light fixture may be mounted with two or more supporting members. In this case, in an embodiment, the total length of the two or more supporting members is essentially the same as the length of one edge of the recessed light fixture. Furthermore, the supporting member may also be a closed-loop configuration, with the closed-loop configuration of the supporting member conforming to the configuration enclosed by the edge of the recessed light fixture. Alternatively, the lower part of the housing of the recessed light fixture, with the configuration of the loops being identical, in which case the ventilation kit comprises only one supporting member with the closed-loop configuration.

The ventilation kit of this invention has the advantages of a simple structure, easy installation, with no change to the structure of the existing recessed light fixtures, enabling the integration of ventilation into existing recessed light fixtures.

A second function of this invention is to provide a recessed light fixture assembly with ventilation, the recessed light fixture assembly comprising a recessed light fixture and the above-described ventilation kit. The recessed light fixture comprises a housing and at least one outward extended horizontal edge at the lower part of the housing.

DETAILED DESCRIPTION

This invention is further described in details below with reference to the accompanying drawings and specific embodiments.

Figure 1:
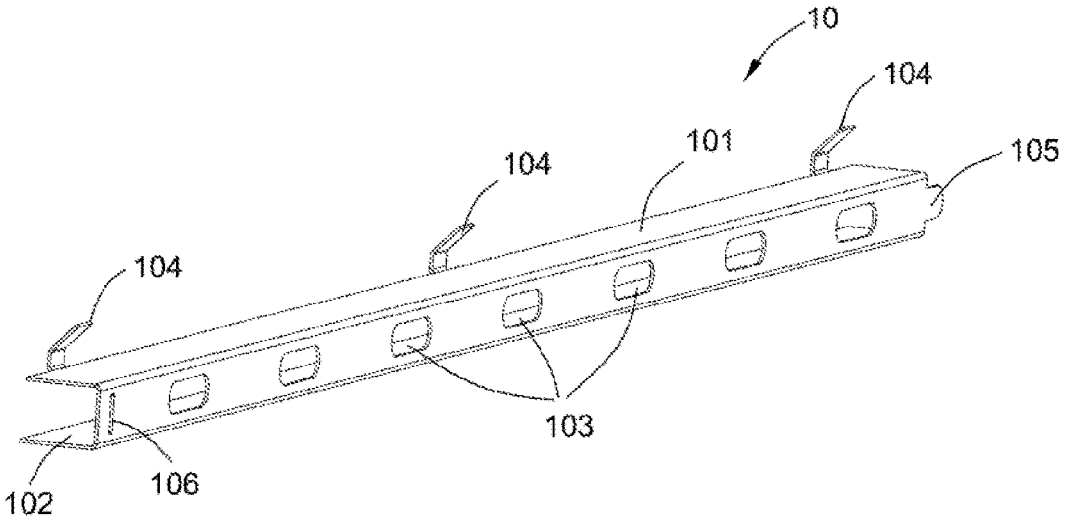
FIG. 1 is a schematic view of a supporting member according to the first embodiment of the invention.
Figure 2:
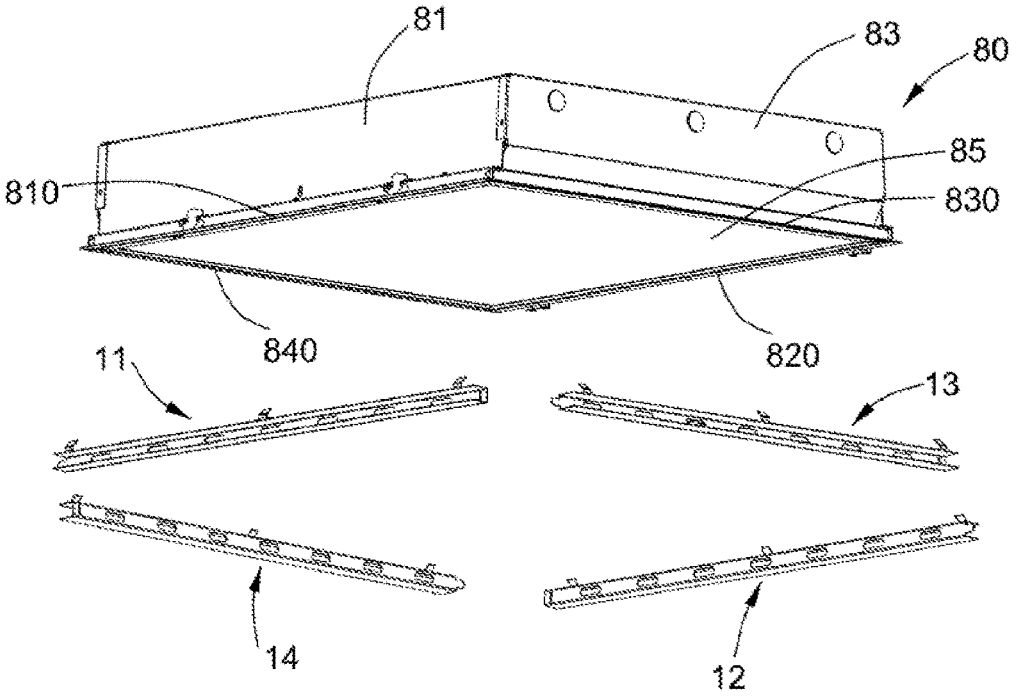
FIG. 2 is a schematic view of the assembly of the recessed light fixture and the ventilation kit according to the first embodiment of the invention.

FIG. 1 shows a schematic perspective view of supporting member 10 according to the first embodiment of the invention. FIG. 2 shows a schematic assembly view of the first embodiment of recessed light fixture 80 and the ventilation kit (comprising the four supporting members 11, 12, 13, and 14 with the same dimension and structure as supporting member 10). The recessed light fixture 80 is a light fixture with a rectangular opening, suitable for mounting onto a ceiling grid system measuring 2 feet*2 feet (609.6 mm*609.6 mm). Recessed light fixture 80 comprises two pairs of opposing side walls 81 and 82 (82 not shown in FIG. 2), and 83 and 84 (84 not shown in FIG. 2), light diffusion plat 85, as well as the four edges 810, 820, 830, 840 located at the lower part of the housing of the four side walls 81, 82, 83, and 84, and extending outward, where the four edges 810, 820, 830, and 840 are enclosed a square.

As shown in FIG. 1, supporting member 10 comprises the first portion 101 adapted to be coupled with one of the edges of the recessed light fixture 80, the second portion 102 adapted to be coupled with a grid system of the ceiling (shown as 90 in FIG. 5), as well as a plurality of through-holes 103 for fluid flow. The cross-section of supporting member 10 is C-shaped or U-shaped with a right angle. The first portion 101 of supporting member 10 is a horizontal structure comprising three protruding parts 104. During the installation, the three protruding parts 104 can be clamped onto the edge of recessed light fixture 80 by bending three protruding parts 104, thereby mounting supporting member 10 onto the recessed light fixture 80. The second portion 102 of supporting member 10 is also a horizontal structure having the same width as the first portion 101. The through holes 103 of supporting member 10 are located on a vertical plane. The size and number of through holes 103 can be adjusted according to ventilation needs. In another embodiment, through holes 103 may also be in the form of grids or shutters. Supporting member 10 has tab 105 and hole 106 at the two ends respectively. During installation, all supporting members can be connected end-to-end by inserting the tab of each supporting member into the hole of the adjacent supporting member where they are bent. The specific dimension of supporting member 10 in this embodiment is 585 mm*20 mm*16 mm. Supporting member 10 is integrally formed from a metal or plastic material.

Figure 3:
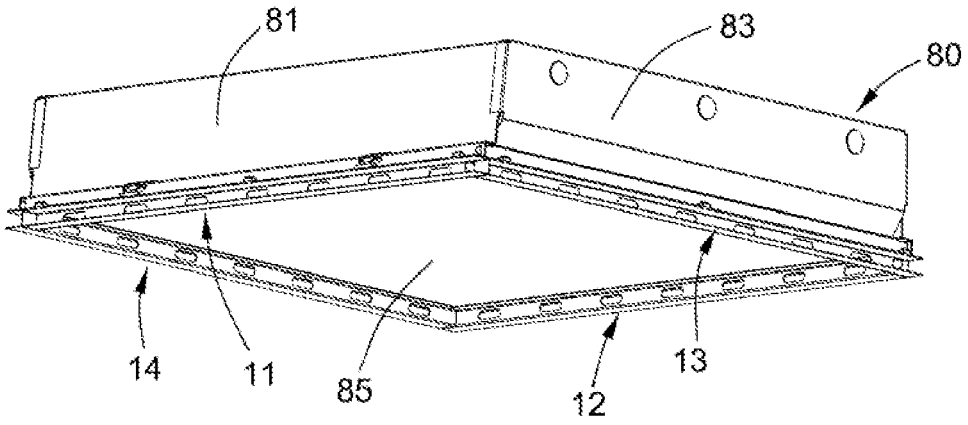
FIG. 3 is a schematic view of the recessed light fixture assembly with ventilation according to the first embodiment of the invention.

As shown in FIG. 2, four supporting members 11, 12, 13, and 14 have the same structure as supporting member 10 constitutes a ventilation kit that is suitable for recessed light fixture 80. Supporting members 11, 12, 13, and 14 are coupled respectively with the four edges 810, 820, 830, and 840 of recessed light fixture 80. In particular, this is done by clamping the tabs of the first portion of each supporting member onto the edge of the light fixture by bending, so that the supporting members are respectively fixed onto the edge of recessed light fixture 80. The recessed light fixture assembly after installation is as shown in FIG. 3. During installation, the four supporting members 11, 12, 13, and 14 are connected end-to-end by inserting a tab on one end of each supporting member into a hole on one end of the adjacent supporting member and bending it to form a square frame.

Figure 4:
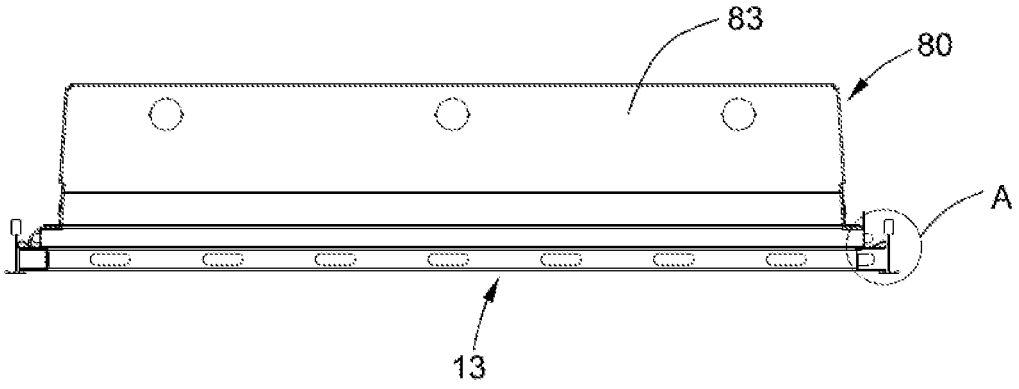
FIG. 4 is a side view of FIG. 3.
Figure 5:
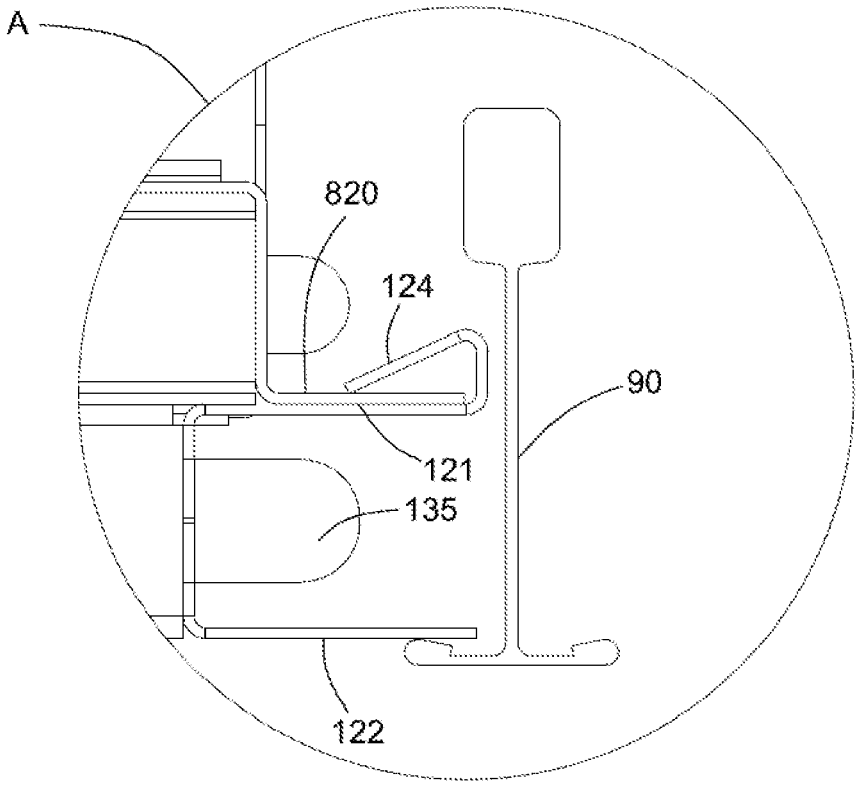
FIG. 5 is an enlarged view of part A in FIG. 4.

FIG. 4 shows a side view of recessed light fixture 80 after the ventilation kit is installed, and also includes the structure of the grid. An enlarged view of part A in FIG. 4 is shown in FIG. 5. The first portion 121 of supporting member 12 is coupled with edge 820 of recessed light fixture 80. Specifically, supporting member 12 is hooked onto edge 820 by bending tab 124 of supporting member 12. The second portion 122 of supporting member 12 is coupled onto inverted T-shaped grid system 90, and the first portion 121 of supporting member 10. The vertical portion has a plurality of through holes, and the second portion 122 forms a C-shaped or U-shaped cross-section.

The connection between the first portion of each supporting member and the edge of the recessed light fixture, in addition to being achieved by bending the tab of the supporting member for hooking onto the edge of the recessed light fixture in the first embodiment, it can also be achieved using connectors where the supporting member is coupled with the edge of the recessed light fixture, which may be selected from one or more of screws and rivets. The tab is not required for the first portion of the supporting member when coupled using connectors.

Supporting member 10 is also suitable for recessed light fixtures of greater dimensions. For example, when installing a recessed light fixture onto a ceiling grid system with a dimension of 2 feet*4 feet (609.6 mm*1219.2 mm), it requires six supporting members of the same dimensions as supporting member 10 to constitute a ventilation kit, wherein two supporting members are required for each long side of the recessed light fixture. Of course, the ventilation kit applicable to the recessed light fixture may further comprise four supporting members, of which two supporting members have the same dimension (585 mm*20 mm*16 mm) as supporting member 10, with the other two supporting members having a greater dimension (1192 mm*20 mm*16 mm), for coupling with the wide and long sides of the larger recessed light fixture respectively.

Figure 6:
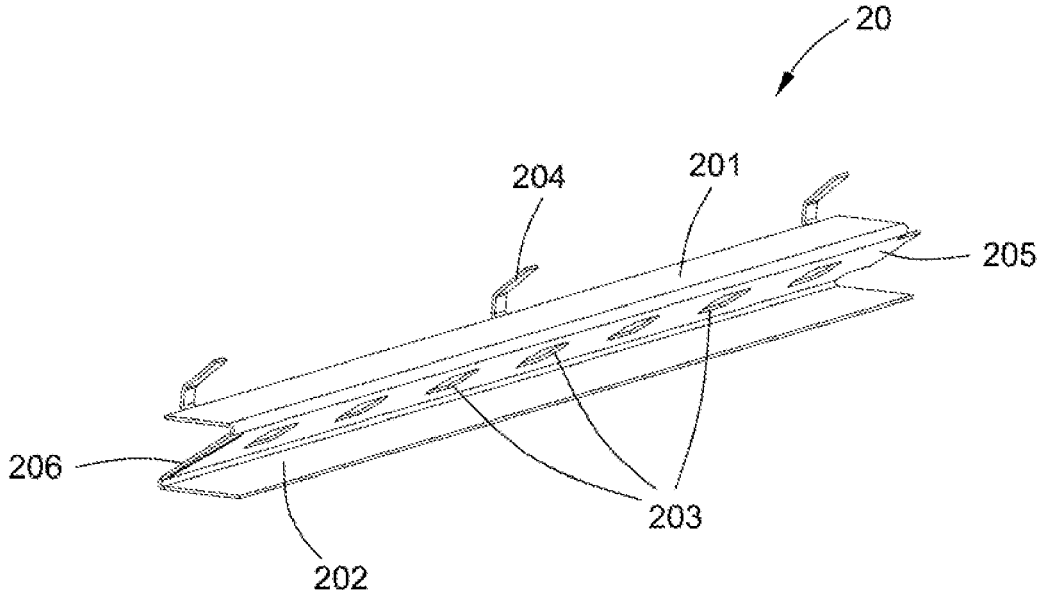
FIG. 6 is a schematic view of a supporting member according to the second embodiment of the invention.

FIG. 6 shows a perspective view of supporting member 20 according to the second embodiment of the invention. Supporting member 20 comprises the first portion 201 for coupling with one of the edges of recessed light fixture 80, the second portion 202 for coupling with the grid system of the ceiling, a plurality of through holes 203 for fluid flow, as well as tabs 205 and holes 206 at both ends. First portion 201 further comprises three tabs 204, where during installation, tabs 204 are made to clamp onto the edges of recessed light fixture 80 through bending tabs 204, thereby mounting supporting member 20 onto recessed light fixture 80. Supporting member 20 has the same dimension as supporting member 10, but the two have different cross sections. The cross section of supporting member 20 is Z-shaped, and through holes 203 are not in the vertical direction but have a certain inclination.

Figure 7:
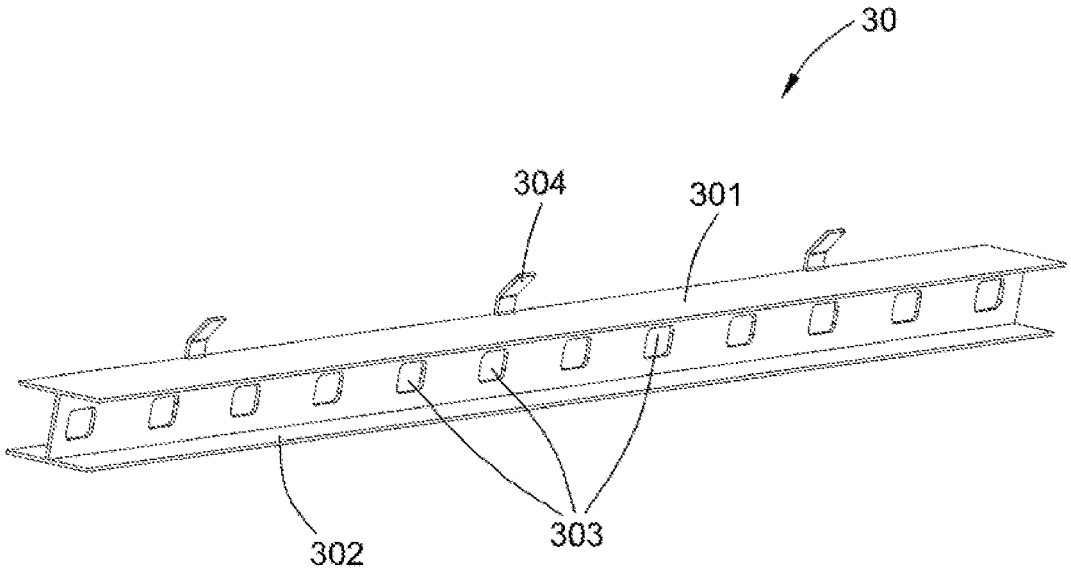
FIG. 7 is a schematic view of a supporting member according to the third embodiment of the invention.

FIG. 7 shows a perspective view of supporting member 30 according to the third embodiment of the invention. Supporting member 30 comprises the first portion 301 for coupling with one of the edges of recessed light fixture 80, the second portion 302 for coupling with the grid system of the ceiling, as well as a plurality of through holes 303 for fluid flow. First portion 301 further comprises three tabs 304, where during installation, tabs 304 are made to clamp onto the edges of recessed light fixture 80 through bending tabs

304, thereby mounting supporting member 30 onto recessed light fixture 80. Supporting member 30 has the same dimension as supporting member 10, but the two have different cross sections. Supporting member 30 has a H-shaped cross section.

Figure 8:
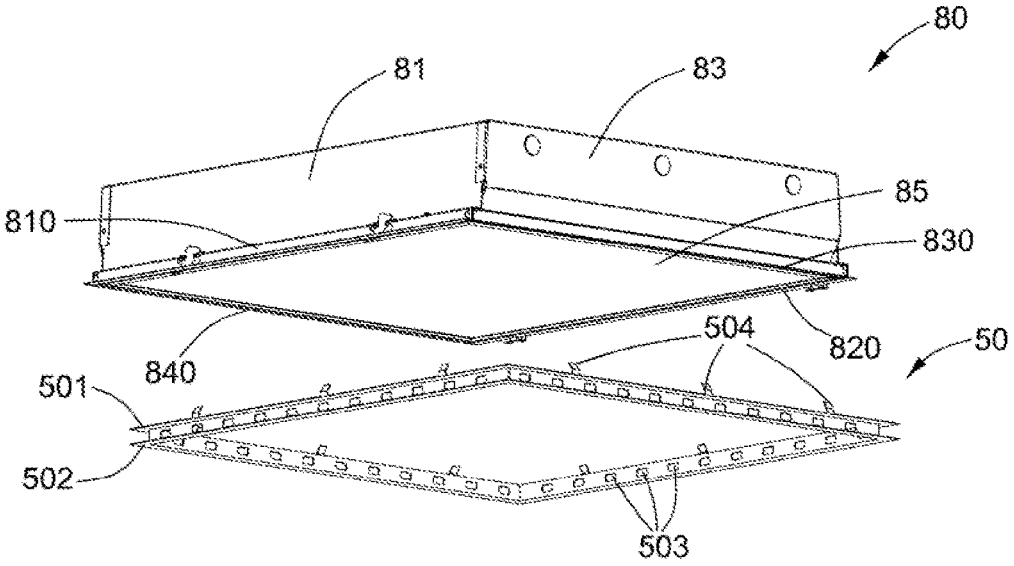
FIG. 8 is a schematic view of the assembly of the recessed light fixture and the ventilation kit according to the fourth embodiment of the invention.

FIG. 8 is a schematic diagram of the assembly of recessed light fixture 80 and the ventilation kit according to the fourth embodiment of the invention. The four edges 810, 820, 830, and 840 of recessed light fixture 80 enclose a square, and the ventilation kit comprises an integrally formed square supporting member 50 that is approximately the same dimension as the edges of recessed light fixture 80. Supporting member 50 comprises the first portion 501 for coupling with the four edges 810, 820, 830, and 840 of recessed light fixture 80, the second portion 502 for coupling with the grid system of the ceiling, as well as a plurality of through holes 503 for fluid flow. The first portion 501 further comprises 12 tabs 504, where during installation, tabs 504 are made to clamp onto the edges of recessed light fixture 80 through bending tabs 504, thereby mounting supporting member 50 onto recessed light fixture 80. After installation, the recessed light fixture assembly has a configuration that is generally similar to that of FIG. 3, except that the ventilation kit of the fourth embodiment includes only one integrally formed square supporting member 50.

While this invention has been described in detail with reference to specific embodiments thereof, those in the industry should understand that many modifications and variations can be made with this invention. It is, therefore, to be understood that the appended claims are intended to cover all such modifications and variations insofar as they are within the scope of this invention.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What we claim is:

1. A ventilation kit adapted to be coupled to a recessed light fixture, the recessed light fixture having a housing and at least one edge extending from a lower portion of said housing, the ventilation kit comprising at least one supporting member, the supporting member comprising:

a first portion being adapted to be coupled to the at least one edge of the recessed light fixture;

a second portion being adapted to be coupled to a grid system of a ceiling; and at least one through hole for fluid flow, wherein the first portion of the supporting member comprises at least one protrusion for clamping the at least one edge of the recessed light fixture through bending the at least one protrusion.

2. The ventilation kit according to claim 1, wherein the supporting member has a cross-section of substantially C-shaped, substantially Z-shaped, or substantially H-shaped.

3. The ventilation kit according to claim 1, wherein the supporting member is integrally formed.

4. The ventilation kit according to claim 1 wherein the at least one through hole is adapted for air return from a space beneath the recessed light fixture to a space above the recessed light fixture.

5. The ventilation kit according to claim 1, wherein the supporting member comprises a first close-loop configuration, the first close-loop configuration having a substantially same shape and a substantially same size as a second close-loop configuration formed by the edges of the recessed light fixture.

6. The ventilation kit according to claim 1, wherein the supporting member comprises a first rectangular configuration, the first rectangular configuration having a substantially same size as a second rectangular configuration formed by the edges of the recessed light fixture.

7. The ventilation kit according to claim 1, wherein the supporting member comprises a bar configuration.

8. The ventilation kit according to claim 7, wherein the supporting member has a substantially same length as the at least one edge of the recessed light fixture.

9. A recessed light fixture assembly with a ventilation function comprising:

a recessed light fixture having a housing and at least one edge extending from a lower portion of said housing; and a ventilation kit adapted to be coupled to the recessed light fixture according to claim 1, the ventilation kit comprising at least one supporting member.

10. The ventilation kit according to claim 1 wherein each of the supporting members has a tab and a hole at two ends thereof respectively adapted for end-to-end connection of the supporting members through inserting the tab of a supporting member to the hole of an adjacent supporting member during installation.

11. A ventilation kit adapted to be coupled to a recessed light fixture, the recessed light fixture having a housing and at least one edge extending from a lower portion of said housing, the ventilation kit comprising at least one supporting member, the supporting member comprising:

a first portion being adapted to be coupled to the at least one edge of the recessed light fixture;

a second portion being adapted to be coupled to a grid system of a ceiling; and at least one through hole for fluid flow, wherein the first portion of the supporting member is adapted to be coupled to the at least one edge of the recessed light fixture through a connector, the connector being selected from one of screw, rivet and bolt.

* * * * *